US007938174B2

(12) United States Patent
Yanagida et al.

(10) Patent No.: US 7,938,174 B2
(45) Date of Patent: May 10, 2011

(54) TEMPERATURE CONTROLLING APPARATUS

(75) Inventors: Akihito Yanagida, Nishitokyo (JP); Shunji Yamada, Yokosuka (JP)

(73) Assignee: Sumitomo Heavy Industries, Ltd., Shinagawa-Ku, Tokyo (JP)

( * ) Notice: Subject to any disclaimer, the term of this patent is extended or adjusted under 35 U.S.C. 154(b) by 1275 days.

(21) Appl. No.: 11/518,989

(22) Filed: Sep. 12, 2006

(65) Prior Publication Data

US 2007/0000641 A1 Jan. 4, 2007

(30) Foreign Application Priority Data

Mar. 31, 2005 (JP) ..... 2005-100656

(51) Int. Cl.

| | |
|---|---|
| ***F24F 3/00*** | (2006.01) |
| ***F25B 29/00*** | (2006.01) |
| ***F28D 15/00*** | (2006.01) |
| ***G05D 23/00*** | (2006.01) |
| ***G01K 1/08*** | (2006.01) |

(52) U.S. Cl. ..... 165/206; 165/64; 165/104.11; 165/201; 165/287; 374/141

(58) Field of Classification Search ..... 165/61, 165/64, 65, 104.11, 108, 201, 206, 287, 299; 374/141; 438/795

See application file for complete search history.

(56) References Cited

U.S. PATENT DOCUMENTS

2002/0003037 A1* 1/2002 Cousineau et al. ..... 165/278

FOREIGN PATENT DOCUMENTS

| | | |
|---|---|---|
| JP | 2002-124558 | 4/2002 |
| JP | 2002-353297 | 12/2002 |
| JP | 2003-148852 | 5/2003 |

* cited by examiner

*Primary Examiner* — Ljiljana (Lil) V Ciric
*Assistant Examiner* — Travis Ruby
(74) *Attorney, Agent, or Firm* — Squire, Sanders & Dempsey (US) LLP

(57) ABSTRACT

A temperature controlling apparatus that controls the temperature of a temperature-controlling object is disclosed. The temperature controlling apparatus includes an atmospheric coolant circulating line that circulates a coolant through a cooling path arranged at the temperature-controlling object; a heat transfer plate heater that heats the temperature-controlling object; and a coolant discharge part that discharges the coolant remaining in the cooling path when the circulation of the coolant is stopped. When the temperature of the temperature-controlling object is to be controlled to change from a low temperature to a high temperature, the circulation of the coolant is stopped and the coolant discharge part discharges the coolant remaining in the cooling path.

6 Claims, 4 Drawing Sheets

TEMPERATURE CONTROLLING APPARATUS

BACKGROUND OF THE INVENTION

1. Field of the Invention

The present invention relates to a temperature controlling apparatus that controls the temperature of a temperature-controlling object such as a heat transfer plate by cooling the heat transfer plate using a coolant of a coolant circulating apparatus and heating the heat transfer plate using an electrothermal heater.

2. Description of the Related Art

Conventionally, a temperature controlling apparatus that controls the temperature of a temperature-controlling object such as a heat transfer plate uses a coolant circulating apparatus to circulate a coolant through a cooling path arranged at the temperature-controlling object to cool the temperature-controlling object, and uses an electrothermal heater that is arranged at the temperature-controlling object to heat the temperature-controlling object. For example, the temperature of the temperature-controlling object may be controlled to be within a range of −70° C. to 200° C. FIG. 1 is a circuit diagram showing an exemplary configuration of a temperature controlling apparatus including a coolant circulating apparatus.

In FIG. 1, the temperature of a temperature-controlling object such as a heat transfer plate P' is controlled. Specifically, the heat transfer plate P' may be cooled by a coolant 104 (referred to as 'cooling liquid 104' hereinafter) of a coolant circulating apparatus that is cooled at a refrigerator 101 and is circulated through a cooling path 108 arranged at the heat transfer plate P', or the heat transfer plate P' may be heated by a heat transfer plate heater 109 installed in the heat transfer plate P'. It is noted that the heat transfer plate P' is normally positioned so that the cooling path 108 may be substantially horizontal.

The refrigerator 101 includes a compressor 102 and a heat exchanger 103. It is noted that a circulating circuit is formed in the refrigerator 101 for circulating a coolant (referred to as 'refrigerator side coolant' hereinafter) through the compressor 102→the heat exchanger 103→the compressor 102 in the direction indicated by the arrows shown in FIG. 1. The heat exchanger 103 includes a refrigerator side coolant path 103*a* where the refrigerator side coolant is circulated and a cooling liquid path 103*b* where the cooling liquid 104 that cools the heat transfer plate P' is circulated. It is noted that when the cooling liquid 104 passes through the cooling liquid path 103*b*, heat may be transferred from the cooling liquid 104 to the refrigerator side coolant that is cooled at the refrigerator 101 so that the cooling liquid 104 may be cooled.

The coolant circulating apparatus that controls the temperature of the heat transfer plate P' includes a low temperature tank 105 that stores the cooling liquid 104, a circulating pump 106 that circulates the cooling liquid 104, a cooling liquid heater 107 having an electrothermal heater for heating the cooling liquid 104 stored in the low temperature tank 105, the cooling path 108 arranged at the heat transfer plate P', and the cooling liquid path 103*b* arranged at the heat exchanger 103. In the coolant circulating apparatus, a circulating circuit is formed by a circulating line L' that circulates the cooling liquid 104 through the low temperature tank 105→the circulating pump 106→the cooling path 108 of the heat transfer plate P'→the cooling liquid path 103*b* of the heat exchanger 103→the cooling liquid heater 107→the low temperature tank 105 in the direction indicated by the arrows shown in FIG. 1. The heat transfer plate heater 109 is installed in the heat transfer plate P', and is controlled based on the temperature detected by a temperature sensor 109*a* arranged at the heat transfer plate P' to heat the heat transfer plate P' to a predetermined temperature.

In the following, operations of the coolant circulating apparatus of FIG. 1 are described. In the case of controlling and adjusting the temperature of the heat transfer plate P' to a temperature higher than 40° C., operations of the circulating pump 106 are stopped, and the heat transfer plate heater 109 installed in the heat transfer plate P' is activated. The heat transfer plate heater 109 controls the temperature of the heat transfer plate P' to be a predetermined temperature based on the temperature detected by the temperature sensor 109*a* that is arranged at the heat transfer plate P'.

In the case of controlling the temperature of the heat transfer plate P' to be a temperature that is less than or equal to 40° C., the circulating pump 106 is operated. The circulating pump 106 transfers the cooling liquid 104 accommodated in the low temperature tank 105 to the cooling path 108. In this way, heat is transferred from the heat transfer plate P' to the cooling liquid 104 transferred to the cooling path 108. Then, the cooling liquid 104 within the cooling path 108 is transferred to the cooling liquid path 103*b* of the cooling heat exchanger 103 where heat transfer occurs from the cooling liquid 104 to the refrigerator side coolant flowing through the refrigerator side coolant path 103*a* so that the cooling liquid 104 may be cooled. Then, the cooling liquid 104 is transferred back to the low temperature tank 105 via the cooling liquid heater 107. In this way, the cooling liquid 104 circulates around the circulating line L' so that the temperature of the cooling liquid 104 within the low temperature tank 105 may be gradually decreased. It is noted that the temperature of the cooling liquid 104 within the low temperature tank 105 is monitored by a temperature sensor 107*a* arranged at the low temperature tank 105. When the temperature of the cooling liquid 104 within the low temperature tank 105 is cooled to a temperature below the desired temperature (predetermined temperature), the cooling liquid heater 107 is driven based on the detected temperature of the temperature sensor 107*a* to maintain the temperature of the cooling liquid 104 in the low temperature tank 105 at the predetermined temperature. It is noted that in certain specific examples, temperature control of the cooling liquid 104 in the low temperature tank 105 may be performed using a flow rate adjusting valve as is illustrated in FIG. 1 of Japanese Laid-Open Patent Publication No. 2003-148852 or a heater arranged at a low temperature tank as is illustrated in FIG. 2 of the same document.

The heat transfer plate P' is cooled by the cooling liquid 104 in the low temperature tank 105 that is maintained at the predetermined temperature and is circulated through the cooling path 108 of the heat transfer plate P'. It is noted that the temperature of the heat transfer plate P' is monitored by the temperature sensor 109*a*, and the heat transfer plate heater 109 is controlled based on the temperature detected by the temperature sensor 109*a*. Accordingly, the temperature of the heat transfer plate P' may be lowered by the cooling liquid 104 and raised by the heat transfer plate heater 109 to be controlled at the predetermined temperature.

As is mentioned above, Japanese Laid-Open Patent Publication No. 2003-148852 discloses technology related to a temperature controlling apparatus. Japanese Laid-Open Patent Publication No. 2002-124558 and Japanese Laid-Open Patent Publication No. 2002-353297 disclose technology related to a heat transfer plate.

It is noted that in the case of controlling the temperature of the heat transfer plate P' to become a high temperature above 90° C., for example, the temperature controlling apparatus as is described above stops the operation of the circulating pump 106 and uses the heat transfer plate heater 109 to increase the temperature of the heat transfer plate P'. However, since the cooling liquid 104 remains in the cooling path 108 of the heat transfer plate P', the heat capacity of the heat transfer plate P' may be relatively large and a relatively long period of time may be required to increase the temperature of the heat transfer plate P' using the heat transfer plate heater 108.

Further, in the case of controlling the temperature of the heat transfer plate P' to become an even higher temperature of over 150° C. such as 200° C., depending on the type of cooling liquid used or the temperature conditions of the cooling liquid, evaporation or oxidation of the cooling liquid may occur, or poisonous gas may be generated due to the fact that the cooling liquid 104 remains within the cooling path 108 of the heat transfer plate P'. Such a problem may occur upon controlling the heat transfer plate P' to become a high temperature particularly in a case where a coolant that is effective in a low temperature range (e.g. less than or equal to 0° C.) is used.

SUMMARY OF THE INVENTION

According to an aspect of the present invention, a temperature controlling apparatus is provided that includes an atmospheric coolant circulating line for circulating a coolant used to cool a temperature-controlling object and an electrothermal heater that is used to heat the temperature-controlling object, the apparatus being configured to prevent the heat capacity of the temperature-controlling object from increasing when the temperature of the temperature-controlling object is increased from a low temperature, reduce the required time for increasing the temperature of the temperature-controlling object with the electrothermal heater, prevent evaporation or oxidation of the coolant or generation of poisonous gas when the temperature-controlling object is controlled to a high temperature, and enable use of a wider variety of coolants.

In one embodiment of the present invention, a temperature controlling apparatus that controls a temperature of a temperature-controlling object is provided, the apparatus including:

an atmospheric coolant circulating line that circulates a coolant through a cooling path arranged at the temperature-controlling object;

a heat transfer plate heater that heats the temperature-controlling object; and a coolant discharge part that discharges the coolant remaining in the cooling path when the circulation of the coolant is stopped; wherein when the temperature of the temperature-controlling object is to be controlled to be a low temperature, the temperature of the temperature-controlling object is controlled by the coolant circulating the coolant circulating line and the heat transfer plate heater;

when the temperature of the temperature-controlling object is to be controlled to be a high temperature, the circulation of the coolant is stopped and the temperature of the temperature-controlling object is controlled by the heat transfer plate heater; and when the temperature of the temperature-controlling object is to be controlled to change from a low temperature to a high temperature, the circulation of the coolant is stopped and the coolant discharge part discharges the coolant remaining in the cooling path.

According to an aspect of the present embodiment, when the temperature-controlling object is to be controlled to change from a low temperature to a high temperature, operations of the circulating pump are stopped, and the coolant remaining in the cooling path of the temperature-controlling object is discharged by the coolant discharge part. At the same time, the heat transfer plate heater may be driven to increase and control the temperature of the temperature-controlling object. Since the coolant does not remain in the cooling path, the heat capacity of the temperature-controlling object may be prevented from increasing. Thus, the required time for increasing the temperature of the temperature-controlling object with the heat transfer plate heater may be reduced. Also, since the coolant remaining in the cooling path of the temperature-controlling object is discharged from the cooling path, the coolant in the coolant circulating line may be prevented from being heated to a high temperature by the heat transfer heater. Therefore, evaporation or oxidation of the coolant and generation of poisonous gas may not occur even if a coolant that is effective in a low temperature range (e.g., less than or equal to 0° C.) is used so that a wider variety of coolants may be used. Further, since the coolant circulating apparatus is connected to the atmosphere, the coolant remaining in the cooling path may be discharged by the coolant discharge part when operations of the circulating pump are stopped.

In one preferred embodiment of the present invention, the coolant discharge part is an air supply line that supplies pressurized air into the cooling path via a coolant inlet of the coolant path.

According to an aspect of the present embodiment, in the case of controlling the temperature of the temperature-controlling object to change from a low temperature to a high temperature, operations of the circulating pump are stopped, pressurized air from the air supply line is supplied to the cooling path of the temperature-controlling object, and the coolant remaining in the cooling path is forcibly discharged from the cooling path. At the same time, the heat transfer plate heater is driven to increase and control the temperature of the temperature-controlling object. Since the coolant does not remain in the cooling path, the heat capacity of the temperature-controlling object may be prevented from increasing. Also, since the coolant remaining in the cooling path of the temperature-controlling object is discharged, the coolant in the coolant circulating line may be prevented from being heated to a high temperature by the heat transfer heater.

In another preferred embodiment of the present invention, the coolant discharge part is a pump arranged at a coolant outlet side of the cooling path.

According to an aspect of the present embodiment, in the case of increasing and controlling the temperature of the temperature-controlling object to change from a low temperature to a high temperature, operations of the circulating pump are stopped, the pump arranged at the coolant outlet side of the cooling path of the temperature-controlling object is operated, and the coolant remaining in the cooling path is forcibly pumped and discharged out of the cooling path. At the same time, the heat transfer plate heater is driven to increase and control the temperature of the temperature-controlling object. Since the coolant does not remain in the cooling path, the heat capacity of the temperature-controlling object may be prevented from increasing. Also, since the coolant remaining in the cooling path of the temperature-controlling object is discharged, the coolant in the coolant circulating line may be prevented from being heated to a high temperature by the heat transfer heater.

In another preferred embodiment of the present invention, the coolant discharge part is configured by arranging the temperature-controlling object so that the coolant within the cooling path is spontaneously discharged when the circulation of the coolant is stopped.

According to an aspect of the present embodiment, in the case of increasing and controlling the temperature of the temperature-controlling object to change from a low temperature to a high temperature, when operations of the circulating pump are stopped, the coolant remaining in the cooling path of the temperature-controlling object is spontaneously discharged (without the use of force). At the same time, the heat transfer plate heater is driven to increase and control the temperature of the temperature-controlling object. Since the coolant does not remain in the cooling path, the heat capacity of the temperature-controlling object may be prevented from increasing. Also, since the coolant remaining in the cooling path of the temperature-controlling object is discharged, the coolant in the coolant circulating line may be prevented from being heated to a high temperature by the heat transfer heater.

DETAILED DESCRIPTION OF THE PREFERRED EMBODIMENTS

In the following, preferred embodiments of the invention are described with reference to the accompanying drawings.

Figure 1:
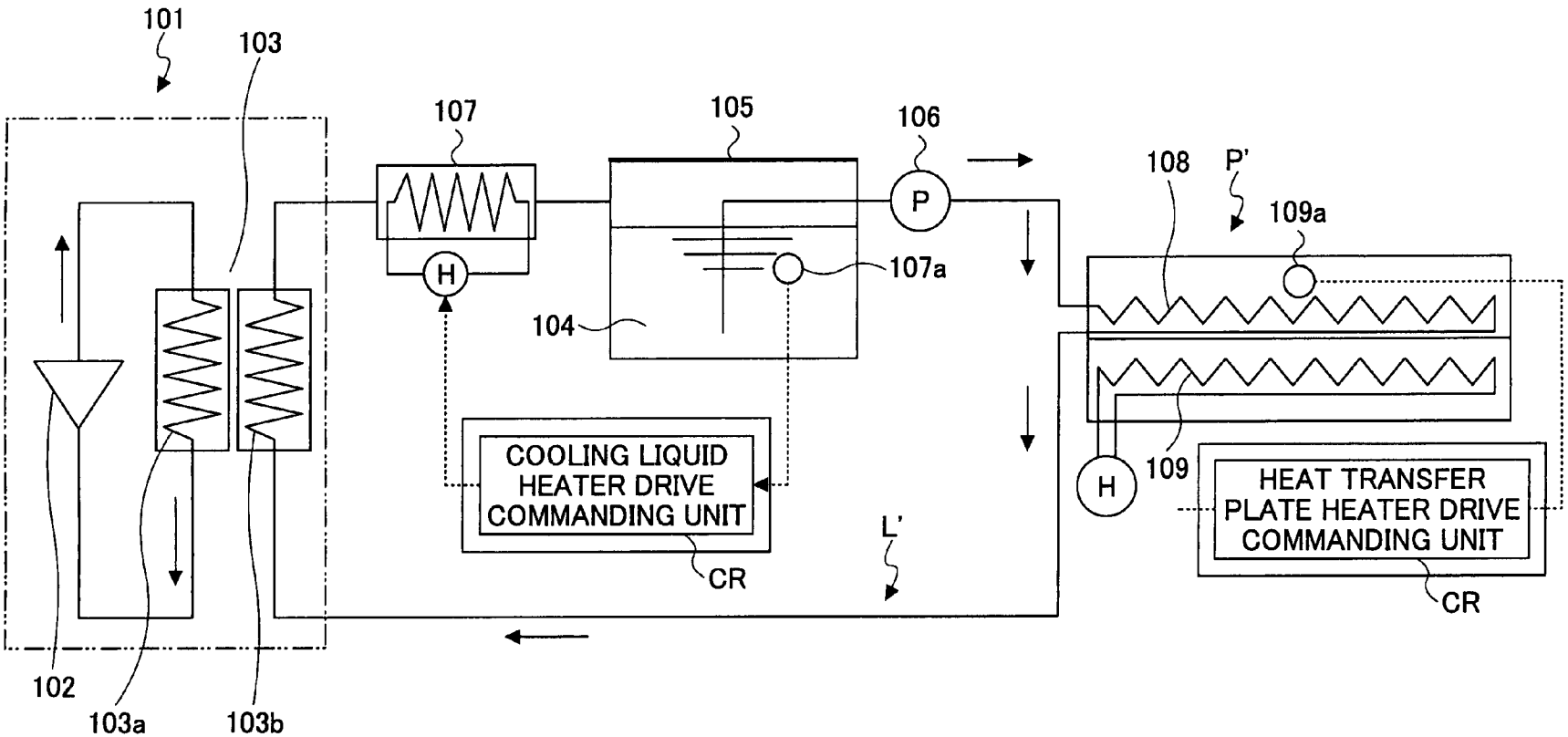
FIG.1 PRIOR ART
FIG. 1 is a diagram showing a configuration of a temperature controlling apparatus according to the prior art.
Figure 2:
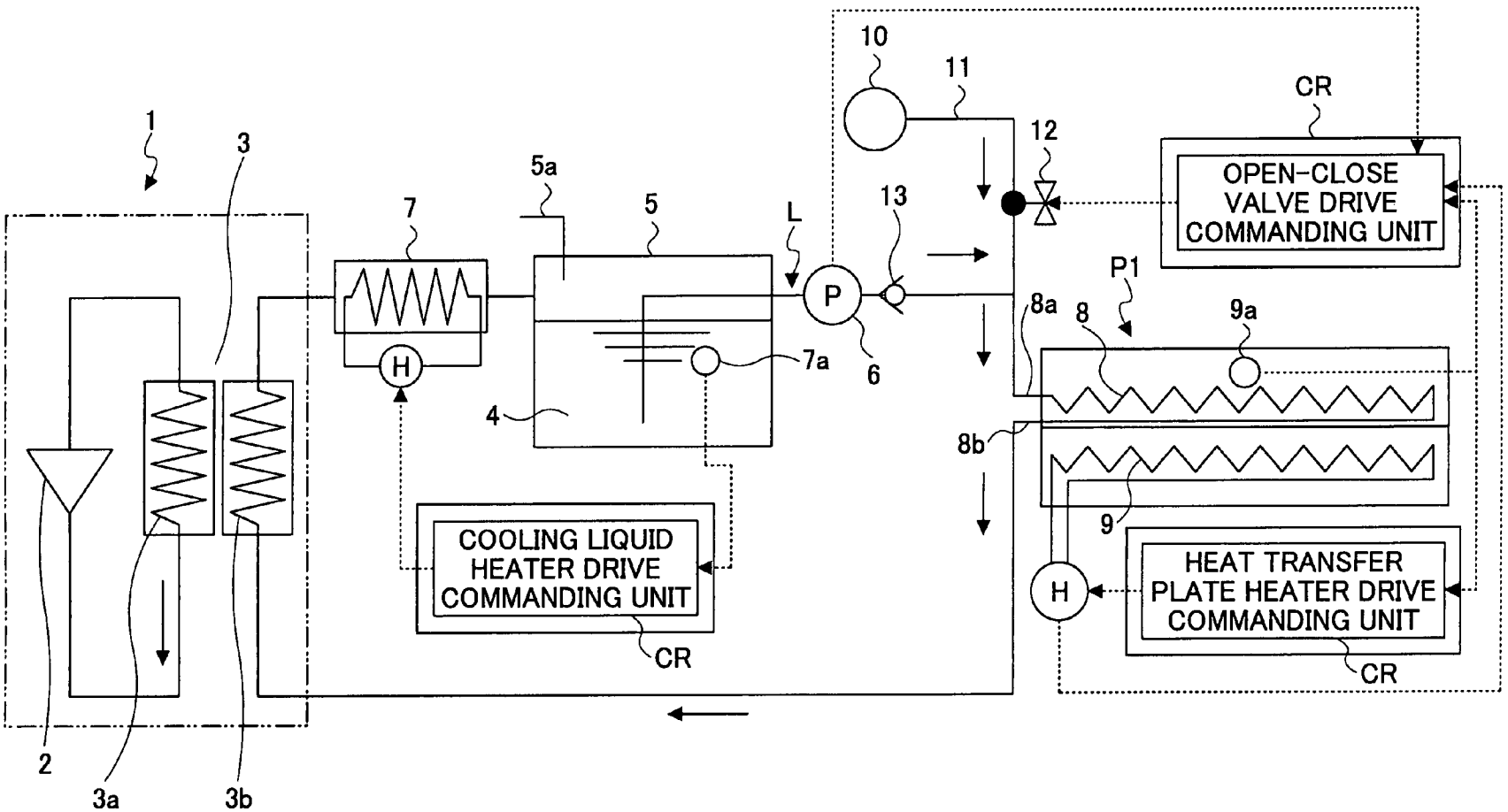
FIG. 2 is a diagram showing a configuration of a temperature controlling apparatus with a coolant discharge part according to a first embodiment of the present invention.
Figure 3:
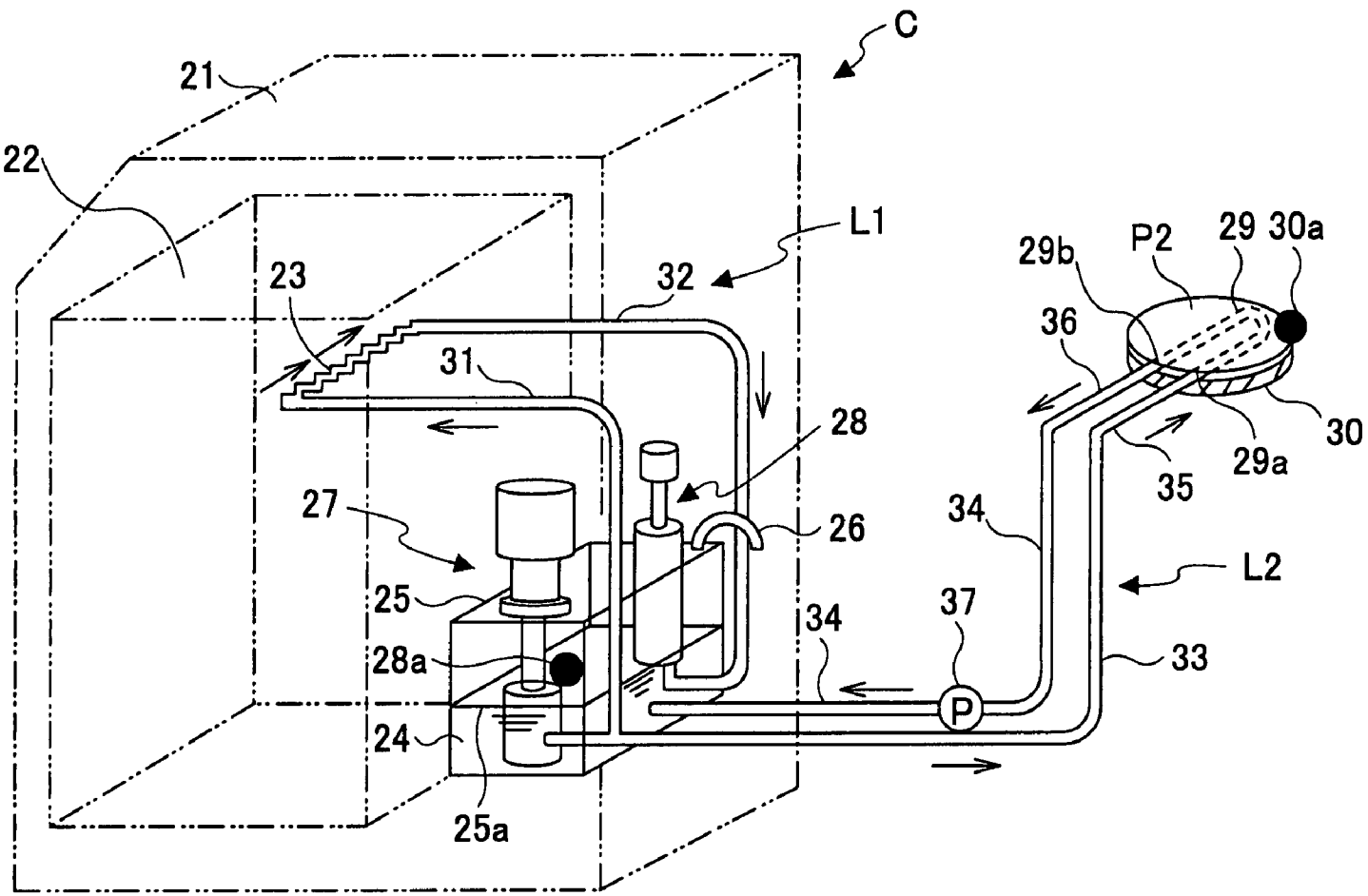
FIG. 3 is a diagram showing a configuration of a temperature controlling apparatus with a coolant discharge part according to a second embodiment of the present invention.
Figure 4:
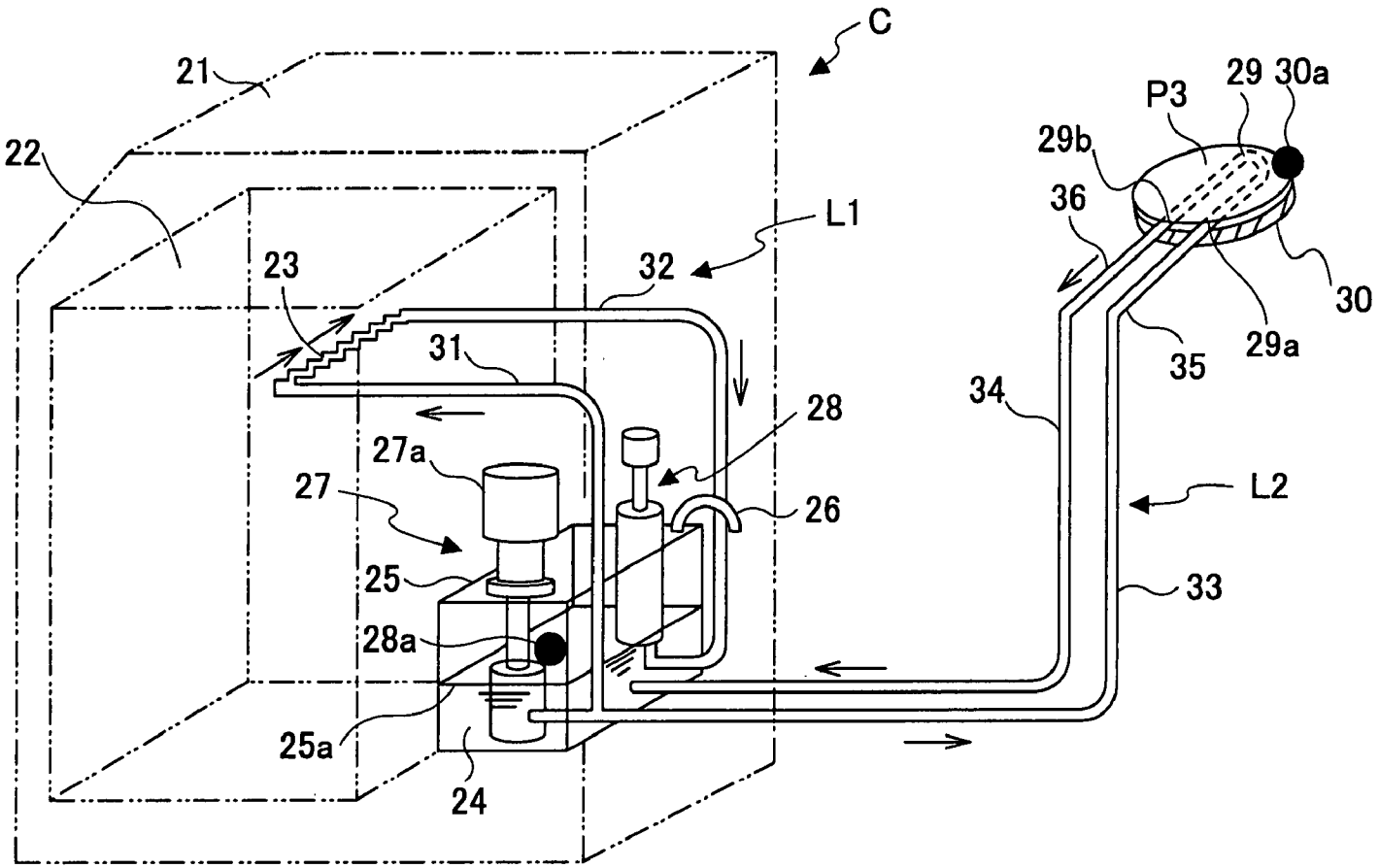
FIG. 4 is a diagram showing a configuration of a temperature controlling apparatus with a coolant discharge part according to a third embodiment of the present invention.

FIG. 2 is a diagram showing a configuration of a temperature controlling apparatus with a coolant discharge part according to a first embodiment of the present invention. In the present embodiment, an air supply line is used as the coolant discharge part. It is noted that in a case where a circulating line L2 as is shown in FIGS. 3 and 4 is used, the air supply line is arranged at a cooling liquid supply hose 33 of the circulating line L2.

Referring to FIG. 2, the illustrated temperature controlling apparatus is configured to control the temperature of a temperature-controlling object such as a heat transfer plate P1. The heat transfer plate P1 may be controlled to be within a temperature range of −70° C. to 200° C., for example, by circulating a coolant 4. (referred to as 'cooling liquid 4' hereinafter) through a cooling path 8 arranged at the heat transfer plate P1, or heating the heat transfer plate P1 using a heat transfer plate heater 9 having an electrothermal heater arranged at the heat transfer plate P1. It is noted that in the present example, a fluorine coolant such as Galden (brand name) or Fluorinert (brand name) may be used as the cooling liquid 4.

The heat transfer plate P1 is usually positioned such that the cooling path 8 formed in the heat transfer plate P1 may be horizontally arranged. The heat transfer plate heater 9 is controlled based on the temperature detected by the temperature sensor 9*a* arranged at the heat transfer plate P1, and heats the heat transfer plate P1 to a predetermined temperature that is set beforehand. It is noted that the heat transfer plate heater 9 may be controlled by any suitable means such as a resistance temperature sensor as is described in Japanese Laid-Open Patent Publication No. 2003-148852. Also, it is noted that although the heat transfer plate P1 is not shown in detail in FIG. 2, the configuration of the heat transfer plate P1 may be similar to that of the heat transfer plate described in Japanese Laid-Open Patent Publication No. 2002-124558 or Japanese Laid-Open Patent Publication No. 2002-353297, for example.

The refrigerator 1 includes a compressor 2 and a heat exchanger 3, and is configured to circulate a coolant (referred to as 'refrigerator side coolant' hereinafter) through the compressor 2→the heat exchanger 3→the compressor 2 in the direction indicated by the arrow shown in FIG. 2. The heat exchanger 3 includes a refrigerator side coolant path 3*a* where the refrigerator side coolant is circulated, and a cooling liquid path 3*b* where the cooling liquid 4 for cooling the heat transfer plate P1 is circulated. By having the cooling liquid 4 pass through the cooling liquid path 3*b*, heat transfer may occur from the cooling liquid 4 to the refrigerator side coolant that has been cooled at the refrigerator 1 so that the cooling liquid 4 may be cooled.

An atmospheric coolant circulating apparatus that controls the temperature of the heat transfer plate P1 includes an atmospheric low temperature tank (coolant tank) 5 for storing the cooling liquid 4, a circulating pump 6 for circulating the cooling liquid 4, a cooling liquid heater 7 including an electrothermal heater for heating the cooling liquid 4 within the low temperature tank 5 to a predetermined temperature, a cooling path 8 that is formed at the heat transfer plate P1, and the cooling liquid path 3*b* arranged at the heat exchanger 3. In this coolant circulating apparatus, the cooling liquid 4 is circulated by a circulating line L (atmospheric coolant circulating line) through the low temperature tank 5→the circulating pump 6→the cooling path 8 of the heat transfer plate P1→the cooling liquid path 3*b* of the heat exchanger 3→the cooling liquid heater 7→the low temperature tank 5 in the direction indicated by the arrows shown in FIG. 2.

The low temperature tank 5 has a substantially sealed heat insulating structure. The upper part of the tank space of the low temperature tank 5 is connected to the atmosphere by an atmosphere connecting tube 5*a*. It is noted that dry air from a dry air supply line (described below) is depressurized to have a weak positive pressure by a speed controller (not shown) and supplied to the upper tank space of the low temperature tank 5 so that the cooling liquid 4 in the low temperature tank 5 may absorb the moisture contained in the air at the upper tank space of the low temperature tank 5 when the temperature is controlled to be less than or equal to 0° C. In this way, the moisture in the air at the upper tank space may be prevented from being condensed into ice.

An air supply line 11 is connected to a cooling path inlet 8*a* side of the heat transfer plate P1. The air supply line 11 supplies pressurized air from an air supply source 10 to the cooling path 8 of the heat transfer plate P1 to discharge the cooling liquid 4 remaining within the cooling path 8. An open-close valve 12 is arranged at the air supply line 11, and air from the air supply source 10 is supplied to the cooling path 8 of the heat transfer plate P1 by the opening operations of this open-close valve 12. Also, a non-return valve 13 is arranged at the discharge side of the circulating pump 6.

The air supply source 10 may employ an air pump or a pressurizing pump, for example. A temperature controlling apparatus that is adapted to control the temperature to be a relatively low temperature generally uses dry air at a pressure of approximately 5 kg/cm$^2$ in order to prevent moisture condensation. In this case, the air supply source 10 may branch out from the dry air supply line 11 so that a separate air supply source does not have to be provided.

The open-close valve 12 may be operated manually or automatically. In one preferred embodiment, an electromagnetic valve is used. The temperature controlling apparatus shown in FIG. 2 uses an electromagnetic valve as the open-close valve 12 that is controlled by a controller CR. Specifically, the controller CR includes an open-close valve drive commanding unit that is electrically connected to the circulating pump 6, the heat transfer heater 9, and the temperature sensor 9*a* arranged at the heat transfer plate P1, and drives the open-close valve 12 based on a detected temperature signal from the temperature sensor 9*a* arranged at the heat transfer plate P1.

The open-close valve drive commanding unit inputs a circulating pump operations stop signal and a heat transfer plate heater drive start signal, and outputs a drive command signal to the open-close valve 12 when a predetermined temperature that is within a temperature range of around several degrees to a dozen degrees; more specifically, a temperature around 10° C., for example, is detected by the temperature sensor 9*a*. It is noted that the predetermined temperature is stored in a storage unit of the controller CR beforehand, and the open-close valve drive commanding unit compares the predetermined temperature stored in the storage unit with the temperature detected by the temperature sensor 9*a* to determine whether the temperature detected by the temperature sensor 9*a* is greater than or equal to the predetermined temperature. Also, it is noted that the drive time for driving the open-close valve 12 is arranged so that the cooling liquid 4 within the cooling path 8 of the heat transfer plate P1 may be transferred to the low temperature tank 5. For example, the open-close valve 12 may be driven for about several seconds to several dozen seconds.

In the following, operations of the temperature controlling apparatus according to the first embodiment are described. In the case of controlling the temperature of the heat transfer plate P1 to be 40° C. or lower, the circulating pump 6 is operated. The circulating pump 6 transfers the cooling liquid 4 in the low temperature tank 5 to the cooling path 8 of the heat transfer plate P1. Then, heat transfer occurs from the heat transfer plate P1 to the cooling liquid 4 transferred to the cooling path 8 after which the cooling liquid 4 is transferred to the cooling liquid path 3*b* of the heat exchanger 3 where transfer occurs from the cooling liquid 4 to the refrigerator side coolant flowing through the refrigerator side coolant path 3*a* of the heat exchanger 3 so that the cooling liquid 4 may be cooled. Then, the cooling liquid 4 is transferred back to the low temperature tank 5 via the cooling liquid heater 7. The cooling liquid 4 circulates around the circulating line L in the manner described above so that the temperature of the cooling liquid 4 within the low temperature tank 5 may gradually decrease to a desired temperature. Also, the temperature of the cooling liquid 4 within the low temperature tank 5 is monitored by the temperature sensor 7*a* arranged at the low temperature tank 5. When the cooling liquid 4 within the low temperature tank 5 is excessively cooled to a temperature below the desired temperature, the cooling liquid heater 7 is driven based on the temperature detected by the temperature sensor 7*a* so that the cooling liquid 4 within the low temperature tank 5 may be adjusted to the desired (predetermined) temperature. It is noted that the cooling liquid heater 7 may be controlled based on the detected temperature of the temperature sensor 7*a* by a controller CR having a cooling liquid heater drive commanding unit, the resistance temperature sensor as is described in Japanese Laid-Open Patent Publication No. 2003-148852, or any other suitable means.

The heat transfer plate P1 may be cooled by having the cooling liquid 4, which is maintained at the predetermined temperature in the low temperature tank 5, circulate through the cooling path 8 of the heat transfer plate P1. At the same time, the temperature of the heat transfer plate P1 is monitored by the temperature sensor 9*a*, and the heat transfer plate heater 9 may be controlled by a controller CR having a heat transfer plate heater drive commanding unit, for example, based on the temperature detected by the temperature sensor 9*a*. Thus, the temperature of the heat transfer plate P1 may be controlled to be the predetermined temperature through cooling by the cooling liquid 4 and heating by the heat transfer plate heater 9.

In the case of increasing and controlling the temperature of the heat transfer plate P1 from a low temperature less than or equal to 0° C. to a high temperature above 40° C., for example, operations of the circulating pump 6 are stopped and the heat transfer plate heater 9 is driven. The open-close valve drive commanding unit of the controller CR inputs and stores a circulating pump operations stop signal and a heat transfer plate heater drive start signal. Also, the open-close valve drive commanding unit inputs the temperature detected by the temperature sensor 9*a*, and compares the input temperature detected by the temperature sensor 9*a* with the predetermined temperature stored beforehand. In the case where the detected temperature is lower than the predetermined temperature, the open-close valve drive commanding unit does not output a drive command signal for driving the open-close valve 12 even if the circulating pump operations stop command signal and the heat transfer plate heater drive start signal are input and stored therein.

When the temperature of the heat transfer plate P1 is increased through heating by the heat transfer plate heater 9 and the predetermined temperature is detected by the temperature sensor 9*a* as the temperature of the heat transfer plate P1, the open-close valve drive commanding unit having the circulating pump operations stop command signal and the heat transfer plate heater drive start signal input and stored therein outputs a drive command signal to the open-close valve 12 to drive the open-close valve 12 for a predetermined period of time.

In the case of raising and controlling the temperature of the heat transfer plate P1 from a temperature above the predetermined temperature to a high temperature above 40° C., since the temperature detected by the temperature sensor 9*a* already exceeds the predetermined temperature, operation of the circulating pump 6 is stopped, the heat transfer plate heater 9 is driven, and the open-close valve drive commanding unit immediately outputs a drive command signal to the open-close valve 12 to drive the open-close valve 12 for a predetermined period of time. After the drive operations for driving the open-close valve 12 is ended, the open-close valve drive commanding unit may be reset.

When the open-close valve 12 is driven, pressurized air from the air supply source 10 is supplied to the cooling path 8 from the cooling path inlet 8*a* of the heat transfer plate P1 via the air supply line 11 and the circulating line L. Since the low temperature tank 5 is connected to the atmosphere, the pressurized air supplied to the cooling path 8 may easily discharge the cooling liquid 4 remaining within the cooling path 8 out of the cooling path 8 via a cooling path outlet 8*b* and transfer the cooling liquid 4 to the low temperature tank 5.

It is noted that since the non-return valve 13 is arranged at the discharge side of the circulating pump 6, the pressurized air may be prevented from entering the low temperature tank 5 via the cooling liquid heater 7 and the circulating pump 6. Also, it is noted that the pressurized air may not be supplied to the cooling path 8 unless the temperature of the heat transfer plate P1 is detected to be at least the predetermined temperature (e.g., around 10° C.) so that even when moisture is contained in the air within the cooling path 8, the moisture may not be condensed and frozen.

Even after the cooling liquid 4 within the cooling path 8 is discharged, the heat transfer plate heater 9 may continue to increase the temperature of the heat transfer plate P1 to control and adjust the temperature of the heat transfer plate P1 to the predetermined temperature based on the detected temperature of the temperature sensor 9*a*. In this case, even when the heat transfer plate P1 is controlled to reach a high temperature, since the cooling liquid 4 is discharged from the cooling path 8 of the heat transfer plate P1, the temperature of the cooling liquid within the circulating line L may be prevented from increasing to a high temperature.

It is noted that in an embodiment where the condensation of moisture of pressurized air does not occur, the detection signal of the temperature sensor 9*a* may not have to be input to the open-close valve drive commanding unit. That is, the open-close valve drive commanding unit may be configured to output a drive command signal to the open-close valve 12 when the circulating pump operations stop signal and the heat transfer plate heater drive start signal are input thereto. In another embodiment, the open-close valve 12 may be a manual valve. In this case, when operations of the circulating pump 6 are stopped and operations of the heat transfer plate heater 9 are started, the temperature detected by the temperature sensor 9*a* may be monitored and the open-close valve 12 may be manually operated.

In the temperature controlling apparatus according to the first embodiment, when the temperature of the heat transfer plate P1 is controlled to increase from a low temperature to a high temperature, the cooling liquid 4 is discharged from the cooling path 8 of the heat transfer plate P1 by the pressurized air from the air supply line 11 so that the heat capacity of the heat transfer plate P1 may not be significantly increased and the required time for heating the heat transfer plate P1 by the heat transfer plate heater 9 may be reduced.

Also, according to the present embodiment, even when the heat transfer plate P1 is heated to a high temperature by the heat transfer plate heater 9, since the cooling liquid 4 is discharged from the cooling path 8 of the heat transfer plate P1, the cooling liquid 4 in the circulating line L may be prevented from being heated to a high temperature. Therefore, even if a coolant that is effective in a low temperature range (e.g., less than or equal to 0° C.) is used, evaporation or oxidation of the coolant or generation of poisonous gas from the coolant may be prevented, and a wider range of coolants may be used in the temperature controlling apparatus.

Further, since the cooling liquid 4 remaining within the cooling path 8 of the heat transfer plate P1 is forcibly discharged by pressurized air, the cooling liquid 4 remaining within the cooling path 8 may be effectively discharged.

Also, in the present embodiment, the above-described air supply operations are performed when the temperature of the heat transfer plate P1 is greater than or equal to a predetermined temperature of approximately 10° C., for example, so that condensation of moisture contained in the air may be avoided and the circulating line L may be protected from undesirable effects resulting from the use of air as coolant discharge means.

In the following, a temperature controlling apparatus with a coolant discharge part according to a second embodiment of the present invention is described with reference to FIG. 3. In the present embodiment, a pump is used as the coolant discharge part, and-the circulating circuit has a different configuration from that of the first embodiment.

The temperature controlling apparatus illustrated in FIG. 3 is configured to control the temperature of a temperature-controlling object such as a heat transfer plate P2. The heat transfer plate P2 may be controlled to have a temperature within a range of −70° C. to 200° C., for example, by circulating a coolant (cooling liquid) 24 of a coolant circulating apparatus through a cooling path 29 arranged at the heat transfer plate P2, or heating the heat transfer plate P2 with a heat transfer plate heater 30 arranged at the heat transfer plate P2. The coolant (cooling liquid) 24 is cooled by a heat exchanger 23 of a refrigerator 22 that is accommodated within a frame 21 of a chiller unit C. It is noted that a fluorine coolant such as Galden (brand name) or Fluorinert (brand name) may be used as the cooling liquid 24, for example.

The heat transfer plate P2 is normally positioned so that the cooling path 29 arranged at the heat transfer path P2 may be substantially horizontal. The heat transfer plate heater 30 is controlled based on the temperature detected by a temperature sensor 30*a* arranged at the heat transfer plate P2 and heats the heat transfer plate P2 so that the temperature thereof may be adjusted to a predetermined temperature. It is noted that the heat transfer plate heater 30 may be controlled in a manner similar to how the heat transfer plate heater 9 of the first embodiment is controlled, for example. Also, although the heat transfer plate P2 is not shown in detail in FIG. 3, and the specific configurations of the heat transfer plate P2 may be similar to that of the heat transfer plate described in Japanese Laid-Open Patent Publication No. 2002-124558 or No. 2002-353297, for example.

The coolant circulating apparatus that controls the temperature of the heat transfer plate P2 includes an atmospheric low temperature tank 25 (coolant tank) that accommodates the cooling liquid 24, a circulating pump 27 that circulates the cooling liquid 24, a flow rate adjusting valve 28 that adjusts the flow rate of the cooling liquid 24 cooled at the heat exchanger 23, a cooling path 29 arranged at the heat transfer plate P2, and a cooling liquid path (not shown) arranged at the heat exchanger 23. Also, a circulating circuit is formed by circulating lines L1 and L2 (described below) in the coolant circulating apparatus.

The heat exchanger 23 has a dual layer tube structure where the inner tube comprises a coolant path for circulating a refrigerator side coolant, and a path formed between the outer tube and the inner tube comprises a cooling liquid path for circulating the cooling liquid 24. Thus, heat may be transferred from the cooling liquid 24 to the refrigerator side coolant at the heat exchanger 23. It is noted that in an alternative embodiment, the cooling liquid 24 from the low temperature tank 25 may be circulated through the inner tube of the heat exchanger 23, and the refrigerator side coolant may be circulated through the path formed between the inner tube and the outer tube of the heat exchanger 23.

The low temperature tank 25 is accommodated within the frame 21 of the chiller unit C and has a substantially sealed heat insulating structure. The upper part of the tank space of the low temperature tank 25 is connected to the atmosphere by an atmosphere connecting tube 26 that is configured to absorb the fluctuations in the pressure of the low temperature tank 25 that occur due to the rise or fall of liquid surface 25*a* level within the low temperature tank 25.

The circulating pump 27 is installed in the low temperature tank 25, and includes a pump part and a drive part. The pump part of the circulating pump 27 is positioned inside the cooling liquid 24 contained in the low temperature tank 25, and the drive part is positioned outside the low temperature tank 25. It is noted that an inlet of the circulating pump 27 is located within the low temperature tank 25, and an outlet of the circulating pump 27 is connected to a cooling liquid circulating hose 31 (feed tube) that feeds the cooling liquid 24 to the heat exchanger 23 and a cooling liquid supply hose 33 that supplies the cooling liquid to the cooling path of the heat transfer plate P2. It is noted that a gear pump is preferably used as the circulating pump 27 although other types of pumps may also be used.

The flow rate adjusting valve 28 is installed in the low temperature tank 25, and includes a drive part and a valve part. The drive part of the flow rate adjusting valve 28 is positioned outside the low temperature tank 25, and the valve part is positioned inside the low temperature tank 25. A coolant inlet of the flow rate adjusting valve 28 is connected to a cooling liquid circulating hose 32 (return tube) that is connected to an outlet of the heat exchanger 23. A coolant outlet of the flow rate adjusting valve 28 is connected to the upper tank space of the low temperature tank 25. The flow rate adjusting valve 25 is controlled based on the detected temperature of a temperature sensor 28*a* arranged at the low temperature tank 25, and is configured to adjust the flow rate of the cooling liquid 24 flowing through the heat exchanger 23 so that the cooling liquid 24 within the low temperature tank 25 may be adjusted to have a predetermined temperature. It is noted that the flow rate adjusting valve 28 may be controlled by a controller or any other suitable means based on the detections made by the temperature sensor 28*a*.

The cooling path 29 formed at the heat transfer plate P2 has a cooling liquid inlet 29*a* that is connected to a heat transfer plate connecting hose 35 (feed tube), and a cooling liquid outlet 29*b* that is connected to a heat transfer plate connecting hose 36 (return tube). The heat transfer plate connecting hose 35 is connected to the cooling liquid supply hose 33 that is connected to the discharge outlet of the circulating pump 27, and the heat transfer plate connecting hose 36 is connected to a cooling liquid supply hose 34 (return tube) that is connected to the interior of the low temperature tank 25.

The cooling path outlet 29*b* of the heat transfer plate P2 is connected to a discharge pump 37 for transferring the cooling liquid 24 remaining within the cooling path 29 of the heat transfer plate P2 to the low temperature tank 25. The discharge pump 37 is preferably positioned at a horizontal portion of the cooling liquid supply hose 34 (return tube) as is shown in FIG. 3. The discharge pump 37 is arranged to have a capacity that is adequate for transferring the cooling liquid 24 remaining within the cooling path 29 of the heat transfer plate P2 which capacity may be relatively small.

The discharge pump 37 may be controlled by a controller (not shown) in a manner similar to how the open-close valve 12 is controlled. In one specific example, a discharge pump drive commanding unit (not shown) included in the controller may be electrically connected to the circulating pump 27 and the heat transfer plate heater 30, and the discharge pump drive commanding unit may be configured to transmit a drive command signal to the discharge pump 37 for driving the discharge pump 37 for a predetermined period of time upon receiving an operations stop signal for stopping operations of the circulating pump 27 and an operations start signal for starting the operations of the heat transfer plate heater 30. It is noted that the drive time for driving the discharge pump 37 may be set to a suitable time for enabling the cooling liquid 24 within the cooling path 29 of the heat transfer path P2 to be transferred to the low temperature tank 25.

As can be appreciated from the above descriptions, the coolant circulating apparatus of the second embodiment includes a circulating line L1 that circulates the cooling liquid 24 through the low temperature tank 25→the circulation pump 27→the cooling liquid circulating hose 31→the cooling liquid path of the heat exchanger 23→the cooling liquid circulating hose 32→the flow rate adjusting valve 28→the low temperature tank 25; and a circulating line L2 (atmospheric coolant circulating line) that circulates the cooling liquid 24 through the low temperature tank 25→the circulating pump 27→the cooling liquid supply hose 33→the heat transfer plate connecting hose 35→the cooling path 29 of the heat transfer plate P2→the heat transfer plate connecting hose 36→the cooling liquid supply hose 34→the discharge pump 37→the cooling liquid supply hose 34→the low temperature tank 25. By including the circulating lines L1 and L2 in the coolant circulating apparatus, temperature compliance characteristics of the cooling liquid 24 in the low temperature tank 25 and the heat transfer plate P2 may be improved, and the capacity of the heat transfer plate heater 30 arranged at the heat transfer plate P2 may be reduced.

In the following, operations of the temperature controlling apparatus according to the second embodiment are described. In the case of controlling the temperature of the heat transfer plate P2 to be a low temperature less than or equal to 40° C., for example, the circulating pump 27 is driven. The circulating pump 27 transfers the cooling liquid 24 within the low temperature tank 25 to the cooling path of the heat exchanger 23 via the cooling liquid circulating hose 31, and also transfers the cooling liquid 24 to the cooling path 29 of the heat transfer plate P2 via the cooling liquid supply hose 33 and the heat transfer plate connecting hose 35.

It is noted that heat transfer occurs from the cooling liquid 24 transferred to the cooling liquid path of the heat exchanger 23 to the refrigerator side coolant flowing through the heat exchanger 23 so that the cooling liquid 24 may be cooled. Then, the cooling liquid 24 is transferred through the cooling liquid circulating hose 32 and the flow rate adjusting valve 28 to be returned to the low temperature tank 25. In this way, the temperature of the cooling liquid 24 flowing within the circulating line L1 may be gradually decreased. On the other hand, the cooling liquid 24 that is transferred to the cooling path 29 of the heat transfer plate P2 is heated as it passes through the cooling path 29. Then, the cooling liquid 24 is transferred through the heat transfer plate connecting hose 36 and the cooling liquid supply hose 34 to be returned to the low temperature tank 25.

The flow rate adjusting valve 28 is controlled based on the temperature detected by the temperature sensor 28*a* arranged within the low temperature tank 25, and adjusts the flow rate of the cooling liquid 24 flowing in the circulating line L1 so that the temperature of the cooling liquid 24 within the low temperature tank 25 may be adjusted to a predetermined temperature according to the predetermined temperature at which the heat transfer plate P2 is to be maintained. At the same time, the temperature of the heat transfer plate P2 is monitored by a temperature sensor 30*a*. When the temperature of the heat transfer plate P2 detected by the temperature sensor 30*a* is lower than the predetermined temperature, a signal is transmitted to the heat transfer plate heater 30 so that the temperature of the heat transfer plate P2 may be adjusted to the predetermined temperature.

In the case of increasing the temperature of the heat transfer plate P2 from a low temperature less than or equal to 0° C., for example, to a high temperature above 40° C., for example, operations of the circulating pump 27 are stopped and the heat transfer plate heater 30 is driven. It is noted that a circulating pump operations stop command signal and a heat transfer plate heater drive start signal are input to and stored in the discharge pump drive commanding unit of the controller. The discharge pump drive commanding unit outputs a drive command signal to the discharge pump 37 upon receiving the circulating pump operations stop command signal and the heat transfer plate heater drive start signal to drive the discharge pump 37 for a predetermined period of time. Since the low temperature tank 25 is connected to the atmosphere, the discharge pump 37 may easily discharge the cooling liquid 24 remaining within the cooling path 29 from the cooling path 29 upon being driven so that the cooling liquid 24 may be returned to the low temperature tank 25. When the drive operations of the discharge pump are ended, the discharge pump drive commanding unit may be reset.

The heat transfer plate heater 30 may heat the heat transfer plate P2 further to control and adjust the temperature of the heat transfer plate P2 to the predetermined temperature based on the temperature detected by the temperature sensor 30*a*. It is noted that in the present embodiment, even when the heat transfer plate P2 is controlled and adjusted to reach a high temperature, the temperature of the cooling liquid 24 in the circulating line L2 may not be significantly increased since the cooling liquid 24 does not remain in the cooling path 29 of the heat transfer plate P2.

In the temperature controlling apparatus according to the second embodiment, when operations of the circulating pump 27 are stopped and the heat transfer plate heater 30 is driven in order to increase the temperature of the heat transfer plate P2 from a low temperature to a high temperature, the cooling liquid 24 remaining within the cooling path 29 of the heat transfer plate P2 is discharged by the discharge pump 37 so that the heat capacity of the heat transfer plate P2 may not be significantly increased and the required time for increasing the temperature of the heat transfer plate P2 with the heat transfer plate heater 30 may be reduced.

Also, even when the temperature of the heat transfer plate P2 is controlled to reach a high temperature by the heat transfer plate heater 30, since the cooling liquid 24 does not remain in the cooling path 29 of the heat transfer plate P2, the cooling liquid 24 in the circulating line L2 may be prevented from being heated to a high temperature. Therefore, evaporation or oxidation of the coolant or generation of poisonous gas may be prevented even when a coolant that is effective at a low temperature range (e.g., less than or equal to 0° C.) is used, and a wider variety of coolants may be used in the temperature controlling apparatus.

Further, since the discharge pump 37 is simply inserted at some point along the cooling liquid supply hose 34 at the cooling path outlet 29*b* side of the heat transfer plate P2, the cooling liquid 24 in the cooling path 29 may be discharged by means of a simple structure. Also, since the cooling liquid 24 is discharged by a pump, accurate discharge of the cooling liquid 24 from the cooing path 29 may be realized.

In the following, a temperature controlling apparatus with a coolant discharge part according to a third embodiment of the present invention is described with reference to FIG. 4. In the present embodiment, arrangements are made on the temperature-controlling object so that the coolant within a cooling path may be discharged spontaneously (e.g., without force) when operations of the circulating pump are stopped.

It is noted that the illustrated component elements of FIG. 4 that are identical to those shown in FIG. 3 are given the same reference numerals and their descriptions are omitted. The temperature controlling apparatus of FIG. 4 differs from that shown in FIG. 3 in that it does not include the discharge pump and has a heat transfer plate as the temperature-controlling object disposed in a different position from that of the heat transfer plate P2 of FIG. 3.

Specifically, since the temperature controlling apparatus of FIG. 4 does not include the discharge pump 37 as is shown in FIG. 3, this apparatus has a circulating line L1 that circulates the cooling liquid 24 through the low temperature tank 25→the circulation pump 27→the cooling liquid circulating hose 31→the cooling liquid path of the heat exchanger 23→the cooling liquid circulating hose 32→the flow rate adjusting valve 28→the low temperature tank 25; and a circulating line L2 (atmospheric coolant circulating line) that circulates the cooling liquid 24 through the low temperature tank 25→the circulating pump 27→the cooling liquid supply hose 33→the heat transfer plate connecting hose 35→the cooling path 29 of a heat transfer plate P3→the heat transfer plate connecting hose 36→the cooling liquid supply hose 34→the low temperature tank 25. It is noted that a controller for controlling the temperature controlling apparatus of the present embodiment does not include a discharge pump drive commanding unit as in the second embodiment since the temperature controlling apparatus of the present embodiment does not include a discharge pump.

The heat transfer plate P3 as the temperature-controlling object of the temperature controlling apparatus of the present embodiment having the circulating lines L1 and L2 is disposed above the low temperature tank 25 and is arranged to be sloped so that the cooling liquid remaining within the cooling path 29 of the heat transfer plate P3 may spontaneously flow toward the cooling liquid supply hoses 33 and 34 by gravitational force. Also, it is noted that the cooling path 29 formed at the heat transfer plate P3 is arranged to have a suitable shape and path structure so that the cooling liquid 24 within the cooling path 29 may flow toward the cooling liquid supply hoses 33 and 34 when operations of the circulating pump 27 are stopped.

In one example, when the cooling path inlet 29*a* and the cooling path outlet 29*b* formed at the heat transfer plate P3 are arranged at the same side of the heat transfer plate P3, the heat transfer plate P3 may be sloped so that the cooling path inlet 29*a* and the cooling path outlet 29*b* are positioned at a lower side. In another example, when the cooling path outlet 29*b* is arranged on the opposite side of the cooling path inlet 29*a*, the heat transfer plate P3 may be sloped so that the cooling path outlet 29*b* is disposed at a lower side, and the cooling path inlet 29*a* is disposed at an upper side. In another example, when the cooling path 29 is formed into a radial path, the shape and disposition of the cooling path 29 is arranged so that the cooling liquid 24 in the cooling path 29 may spontaneously flow out of the cooling path outlet 29*b*.

Also, the cooling liquid supply hoses 33, 34, and the heat transfer plate connecting hoses 35, 36 are arranged so that the cooling liquid 24 flowing out of the cooling path 29 of the heat transfer plate P3 may flow toward the low temperature tank 25 by gravitational force when operations of the circulating pump 27 are stopped. As is shown in FIG. 4, in the temperature controlling apparatus according to the present embodiment, the heat transfer plate connecting hoses 35 and 36 are sloped, and the cooling liquid supply hoses 33 and 34 each include an upright portion that is substantially vertical and a horizontal portion that extends in the horizontal directions.

It is noted that a coolant circulating apparatus of the temperature controlling apparatus according to the present embodiment may operate in a manner similar to how the coolant circulating apparatus of the second embodiment is operated. Specifically, in the case of controlling and adjusting the temperature of the heat transfer plate P3 from a low temperature less than or equal to 0° C., for example, to a high temperature above 40° C., for example, since the heat transfer plate P3 is disposed at a higher position than the low temperature tank 25 and slopes down toward the low temperature tank 25, and the low temperature tank 25 is connected to the atmosphere, the cooling liquid 24 in the cooling path 29 of the heat transfer plate P3 spontaneously flows through the heat transfer plate connecting hoses 35 and 36 by gravitational force so that the cooling liquid 24 flows toward the cooling liquid supply hoses 33 and 34 to be transferred to the low temperature tank 25 side when operations of the circulating pump 27 are stopped. At the same time, the heat transfer plate heater 30 is driven and the temperature of the heat transfer plate P3 is increased and adjusted to the predetermined temperature. It is noted that in the present embodiment, even when the heat transfer plate P3 is adjusted to a high temperature, since the cooling liquid 24 does not remain in the cooling path 29 of the heat transfer plate P3, the temperature of the cooling liquid 24 in the circulating line L2 may be prevented from significantly increasing.

In the case of controlling and adjusting the temperature of the heat transfer plate P3 from a low temperature to a high temperature in the temperature controlling apparatus according to the third embodiment, the cooling liquid 24 in the cooling path 29 of the heat transfer plate P3 may spontaneously flow but of the cooling path 29 when operations of the circulating pump 27 are stopped owing to the disposition and structure of the heat transfer plate P3. Therefore, the heat capacity of the heat transfer plate P3 may be prevented from increasing and the required time for increasing the temperature of the heat transfer plate P3 may be reduced.

Also, even when the heat transfer plate P3 is controlled to be at a high temperature by the heat transfer plate heater 30, since the cooling liquid 24 does not remain in the cooling path 29 of the heat transfer plate heater 30, the cooling liquid 24 in the circulating line L2 may be prevented from being heated to a high temperature. Therefore, evaporation or oxidation of the coolant or generation of poisonous gas may be prevented even in a case where a coolant that is effective at a low temperature range (e.g., less than or equal to 0° C.) is used so that a wider variety of coolants may be used in the temperature controlling apparatus.

Also, according to the present embodiment, the coolant discharge part is realized by simply arranging the heat transfer plate P3 to be sloped and at a position above the low temperature tank 25 to enable discharge of the cooling liquid 24 from the cooling path 29. In other words, since a dedicated device does not have to be provided, the coolant discharge part may be realized by a simple structure. Also, dedicated operations are not necessary and operations of the temperature controlling apparatus may be easily performed.

Although the present invention is shown and described with respect to certain preferred embodiments, it is obvious that equivalents and modifications will occur to others skilled in the art upon reading and understanding the specification. The present invention includes all such equivalents and modifications, and is limited only by the scope of the claims. For example, the temperature controlling apparatus according to an embodiment of the present invention is not limited to controlling the temperature of a heat transfer plate, and the configuration of the circulating line is not limited to the examples described above.

What is claimed is:

1. A temperature controlling apparatus that controls a temperature of a temperature-controlling object, the apparatus comprising:

an atmospheric coolant circulating line that circulates a coolant through a cooling path arranged at the temperature-controlling object;

a heat transfer plate heater that heats the temperature-controlling object;

a coolant discharge part that discharges the coolant remaining in the cooling path when the circulation of the coolant is stopped;

an open-close valve; and a controller configured to drive the open-close valve based on a detected temperature signal from a temperature sensor in the temperature-controlling object, wherein the controller is configured to direct the coolant circulating in the coolant circulating line and the heat transfer plate heater to control the temperature of the temperature-controlling object so that the temperature of the temperature-controlling object is controlled to be a low temperature;

the controller is configured to stop the circulation of the coolant and direct the heat transfer plate heater to control the temperature of the temperature-controlling object so that the temperature of the temperature-controlling object is controlled to be a high temperature; and the controller is configured to stop the circulation of the coolant and direct the coolant discharge part to discharge the coolant remaining in the cooling path so that the temperature of the temperature-controlling object is controlled to change from a low temperature to a high temperature.

2. The temperature controlling apparatus as claimed in claim 1, wherein the coolant discharge part is an air supply line that supplies pressurized dry air into the cooling path via a coolant inlet of the coolant path.

3. The temperature controlling apparatus as claimed in claim 1, wherein the coolant discharge part is a pump arranged at a coolant outlet side of the cooling path.

4. The temperature controlling apparatus as claimed in claim 1, wherein the coolant discharge part is configured by arranging the temperature-controlling object so that the coolant within the cooling path is spontaneously discharged when the circulation of the coolant is stopped.

5. The temperature controlling apparatus as claimed in claim 1, wherein the controller is further configured to input a circulating pump operations stop signal and a heat transfer plate heater drive start signal, and output a drive command signal to the open-close valve when the detected temperature signal from the temperature sensor in the temperature-controlling object is greater than or equal to a predetermined temperature stored in the controller.

6. The temperature controlling apparatus as claimed in claim 1, wherein the coolant discharge part is an air supply line that supplies pressurized air into the cooling path via a coolant inlet of the coolant path, and the open-close valve is arranged at the air supply line.

* * * * *